US008226210B2

(12) United States Patent
Otokita

(10) Patent No.: US 8,226,210 B2
(45) Date of Patent: Jul. 24, 2012

(54) LIQUID EJECTING HEAD AND METHOD OF MANUFACTURING THE SAME

(75) Inventor: Kenji Otokita, Higashichikuma-gun (JP)

(73) Assignee: Seiko Epson Corporation, Tokyo (JP)

( * ) Notice: Subject to any disclaimer, the term of this patent is extended or adjusted under 35 U.S.C. 154(b) by 164 days.

(21) Appl. No.: 12/862,893

(22) Filed: Aug. 25, 2010

(65) Prior Publication Data

US 2011/0050804 A1 Mar. 3, 2011

(30) Foreign Application Priority Data

Sep. 3, 2009 (JP) ..... 2009-203436

(51) Int. Cl.
*B41J 2/16* (2006.01)

(52) U.S. Cl. ..... 347/47; 216/27

(58) Field of Classification Search ..... 347/40, 347/43, 47; 216/27
See application file for complete search history.

(56) References Cited

U.S. PATENT DOCUMENTS

| | | | | |
|---|---|---|---|---|
| 6,966,630 | B2 * | 11/2005 | Sasaki et al. | 347/45 |
| 7,036,909 | B2 | 5/2006 | Kubota et al. | |
| 7,249,815 | B2 * | 7/2007 | Keller et al. | 347/9 |
| 7,441,868 | B2 * | 10/2008 | Seto | 347/45 |

FOREIGN PATENT DOCUMENTS

| | | |
|---|---|---|
| JP | 05-229127 | 9/1993 |
| JP | 2003-025577 | 1/2003 |
| JP | 2003-127387 | 5/2003 |
| JP | 2004-042399 | 2/2004 |
| JP | 2007-175992 | 7/2007 |
| JP | 2008-246785 | 10/2008 |

* cited by examiner

*Primary Examiner* — Lamson Nguyen
(74) *Attorney, Agent, or Firm* — Workman Nydegger

(57) ABSTRACT

A liquid ejecting head has a nozzle substrate made of crystalline material, in which a nozzle through which liquid is ejected is provided by an etching process. The nozzle includes a plurality of continuous nozzle sections having different diameters arranged coaxially in the direction of the thickness of the crystalline material. The nozzle sections include a first nozzle section that is located at the ejection-side end and that has a first diameter, and a second nozzle section that is continuous with the first nozzle section and that has a second diameter larger than the first diameter. The difference between the first diameter and the second diameter is not less than 0.1 and not greater than 0.4 relative to the first diameter.

4 Claims, 6 Drawing Sheets

| (D2−D1)/D1 | 0.1 | 0.16 | 0.2 | 0.28 | 0.32 | 0.36 | 0.4 | 0.44 | 0.5 | 0.6 |
|---|---|---|---|---|---|---|---|---|---|---|
| EVALUATION | GOOD | GOOD | GOOD | GOOD | GOOD | GOOD | GOOD | AVERAGE | AVERAGE | BAD |

LIQUID EJECTING HEAD AND METHOD OF MANUFACTURING THE SAME

The entire disclosure of Japanese Patent Application No: 2009-203436, filed Sep. 3, 2009 are expressly incorporated by reference herein.

BACKGROUND

1. Technical Field

The present invention relates to a liquid ejecting head such as an ink jet recording head and a method of manufacturing the same. In particular, the invention relates to a liquid ejecting head having crystalline material in which a nozzle is formed by an etching process, and to a method of manufacturing the same.

2. Related Art

For example, a liquid ejecting apparatus has a liquid ejecting head that ejects liquid through nozzles. The liquid ejecting apparatus ejects various liquids from the liquid ejecting head. An example of such liquid ejecting apparatuses is an image recording apparatus such as an ink jet printer (hereinafter referred to simply as a printer). The ink jet printer has an ink jet recording head (hereinafter referred to simply as a recording head) which is a liquid ejecting head. Ink in liquid form is ejected through nozzles of the recording head and lands on a recording medium (the object of ejection) such as a recording sheet. An image or the like is thus recorded. Moreover, recently liquid ejecting apparatuses have been applied not only to the image recording apparatus, but also to various manufacturing apparatuses such as an apparatus for manufacturing color filters of liquid crystal displays.

One such recording head has a nozzle substrate in which a plurality of rows of nozzles through which ink is ejected are provided, and pressure chambers that communicate with the nozzles. The pressures in the pressure chambers are changed by a pressure-generating unit, and ink is ejected through the nozzles by using the pressure changes. The pressure-generating unit may be a piezoelectric-type unit that uses a piezoelectric element, a thermal-type unit that uses a heat-generating element, an electrostatic-type unit that uses electrostatic force, or the like.

To fabricate the nozzle substrate, a plate member made of a metal such as stainless steel is plastically deformed with a punch and thereby nozzles are provided therein, for example (see JP-A-05-229127, for example). Each of the nozzles has a cylindrical straight portion on the ejection side, and a tapered portion that is continuous with the straight portion and that increases in diameter from the straight-portion side toward the pressure-chamber side. In order to ensure that a predetermined amount of ink lands at a predetermined location, the nozzles need to be dimensioned and shaped very precisely. Moreover, in order to record a more precise high-resolution image, it has been proposed to fabricate a nozzle plate from a single-crystal silicon substrate (hereinafter referred to simply as a silicon substrate) and form nozzles in the substrate by an etching process (for example, see JP-A-2007-175992). Nozzles formed by an etching process can have a higher degree of dimensional accuracy than nozzles formed by plastic deformation.

When a nozzle is formed in a silicon substrate by an etching process, it is difficult to form the above-mentioned tapered portion. For this reason, a plurality of cylindrical nozzle sections having different diameters and communicating with one another are formed so as to constitute a nozzle having a plurality of sections. Thus, an ink-ejecting characteristic similar to that of the above-described tapered nozzle is obtained. The nozzle section that is located at the ejection-side end has the smallest diameter, and the nozzle sections have successively larger diameters toward the pressure-chamber side. Here, flow-path resistance and inertance of the entire nozzle are considered, and successively different diameters are given to the nozzle sections in this manner so that the desired ink-ejecting characteristic can be obtained.

FIG. 8 is a sectional view of the main part of a nozzle having a plurality of cylindrical nozzle sections as described above, and illustrates the ejection of ink (displacement of the meniscus). In FIG. 8, the upper side is the pressure-chamber side, and the lower side is the ejection side. In a steady-state condition, the meniscus is located near the ejection-side opening of the nozzle. To eject ink, first, the pressure chamber is expanded and the pressure in the pressure chamber is decreased. As a result, the meniscus is drawn toward the pressure-chamber side (FIGS. 8A and 8B). When the meniscus has moved to near the boundary between a first nozzle section on the ejection side and a second nozzle section on the pressure-chamber side, the pressure chamber which has been expanded is rapidly contracted, and the pressure in the pressure chamber is increased. As a result, the middle of the meniscus swells and is pushed toward the ejection side (FIG. 8C). Thereafter, to separate an ink droplet from the meniscus, the pressure chamber is again expanded (FIG. 8D). There is a step portion (a surface that joins adjacent nozzle sections) between the nozzle section on the ejection side and the nozzle section on the pressure-chamber side. In particular, this kind of nozzle tends to have a relatively large difference in diameter between nozzle sections, and have a large step portion. When the pressure chamber is expanded for the second time after the rapid contraction, an entraining flow of ink tends to occur near the step portion from the inner-circumferential-surface side of the nozzle toward the middle of the meniscus, as indicated by arrows in FIG. 8D. More specifically, while the flow of ink at portions relatively remote from the step portion is parallel to the inner wall of the nozzle, a flow of ink parallel to the surface of the step portion occurs near the step portion. Thus, the flow of ink becomes complex and vortices tend to occur. Consequently, there is a risk that bubbles B will be entrained in the ink, as illustrated in FIG. 8E. If such bubbles B are created, there is a risk that the flight of ink will be distorted, and so on. Thus, there is a risk that the ejection of ink will be unstable.

SUMMARY

An advantage of some aspects of the invention is that a liquid ejecting head and a method of manufacturing the same are provided. In the liquid ejecting head, problems in ejection due to the entrainment of bubbles are less likely to occur.

According to an aspect of the invention, a liquid ejecting head includes a nozzle substrate made of crystalline material, in which a nozzle through which liquid is ejected is provided by an etching process. The nozzle includes a plurality of continuous nozzle sections having different diameters arranged coaxially in the direction of the thickness of the crystalline material. The nozzle sections include a first nozzle section that is located at the ejection-side end and that has a first diameter, and a second nozzle section that is continuous with the first nozzle section and that has a second diameter larger than the first diameter. The difference between the first diameter and the second diameter is not less than 0.1 and not greater than 0.4 relative to the first diameter.

The nozzle has a plurality of nozzle sections including the first nozzle section and the second nozzle section. The first nozzle section is located at the ejection-side end and has the first diameter. The second nozzle section is continuous with the first nozzle section and has the second diameter larger than the first diameter. In this configuration, the difference between the first diameter and the second diameter is made not less than 0.1 and not greater than 0.4 relative to the first diameter. Therefore, entrainment of bubbles at the time of ejection of a liquid from the nozzle is less likely to occur as compared with a nozzle of the related art that has a plurality of sections. Thus, even with a liquid ejecting head in which nozzles are formed with high dimensional accuracy by an etching process, problems in ejection due to bubbles can be avoided.

It is preferable that the nozzle sections have successively larger diameters from the first nozzle section.

In this configuration, it is preferable that the differences in diameter between adjacent nozzle sections be successively larger from the first nozzle section.

According to another aspect of the invention, a method of manufacturing a liquid ejecting head is provided. The liquid ejecting head has a nozzle substrate made of crystalline material in which a nozzle through which liquid is ejected is provided. The method includes forming in the crystalline material by an etching process a plurality of continuous nozzle sections having different diameters so as to be arranged coaxially in the direction of the thickness of the crystalline material. The nozzle sections include a first nozzle section that is located at the ejection-side end and that has a first diameter, and a second nozzle section that is continuous with the first nozzle section and that has a second diameter larger than the first diameter. The difference between the first diameter and the second diameter is made not less than 0.1 and not greater than 0.4 relative to the first diameter.

The nozzle has a plurality of nozzle sections including the first nozzle section and the second nozzle section. The first nozzle section is located at the ejection-side end and has the first diameter. The second nozzle section is continuous with the first nozzle section and has the second diameter larger than the first diameter. In this configuration, the difference between the first diameter and the second diameter is made not less than 0.1 and not greater than 0.4 relative to the first diameter. Therefore, entrainment of bubbles at the time of ejection of a liquid from the nozzle is less likely to occur as compared with a nozzle of the related art that has a plurality of sections. Thus, even with a liquid ejecting head in which nozzles are formed with high dimensional accuracy by an etching process, problems in ejection due to bubbles can be avoided.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described below with reference to the accompanying drawings. The embodiment described below is a specific preferred example of an embodiment of the invention, and involves various limitations. However, the scope of the invention is not limited to these features. An ink jet recording head (hereinafter referred to simply as a recording head) that is mounted in an ink jet printer (one type of liquid ejecting apparatus) will be described below as an example of a liquid ejecting head of the invention.

Figure 1:
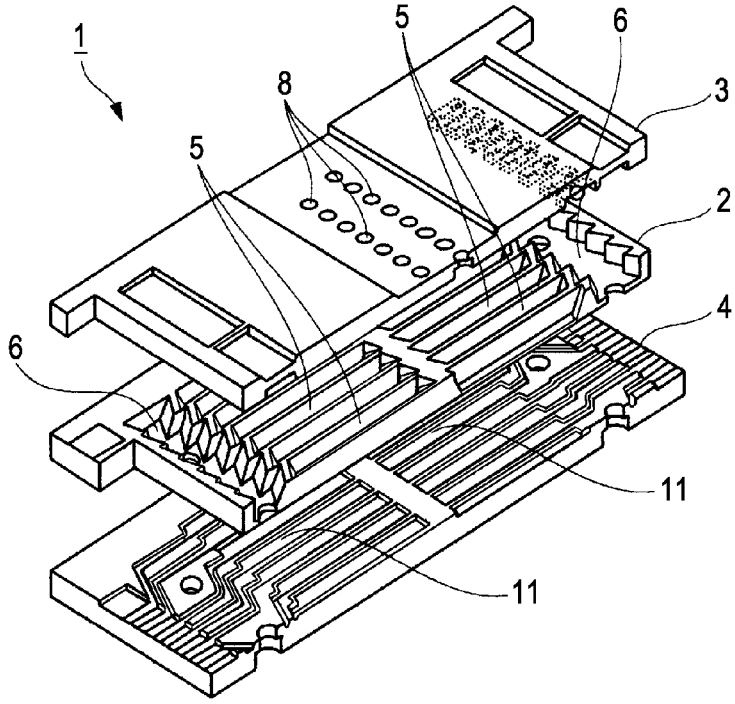
FIG. 1 is an exploded perspective view illustrating a configuration of a recording head.
Figure 2:
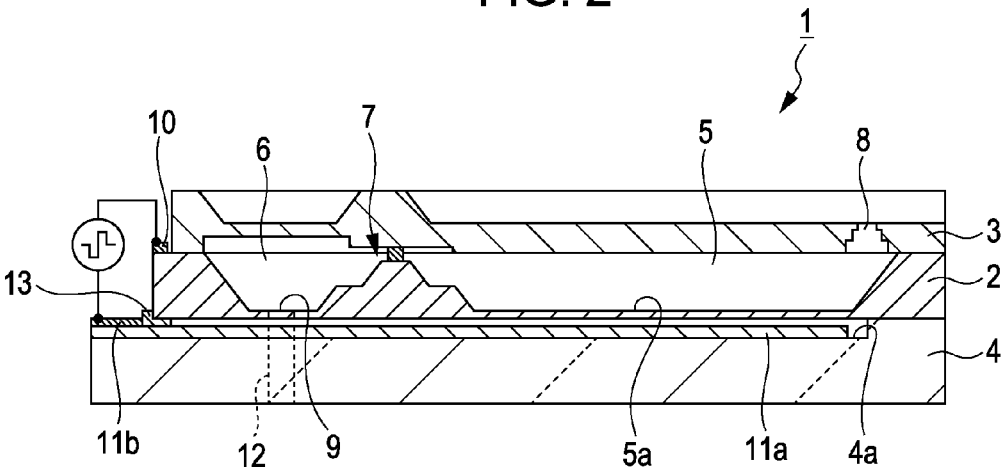
FIG. 2 is a sectional view of the main part of the recording head.

FIG. 1 is an exploded perspective view illustrating a configuration of a recording head 1 of the present embodiment. FIG. 2 is a sectional view of the recording head 1 along the longitudinal direction of pressure chambers. The recording head 1 has a flow-path substrate 2 made of a single-crystal silicon substrate, which is one kind of crystalline material, a nozzle substrate 3 also made of a single-crystal silicon substrate, and an electrode substrate 4 made of glass. The nozzle substrate 3 is disposed on one side of the flow-path substrate 2, and the electrode substrate 4 is disposed on the other side of the flow-path substrate 2. These three substrates are stacked and bonded to one another by using an adhesive.

The nozzle substrate 3 is a plate member in which a plurality of nozzles 8 are formed in rows at a pitch that corresponds to the dot-forming density (for example, 360 dpi). The nozzle substrate 3 will be described in detail later. Groove portions that serve as flow paths for ink are formed in the flow-path substrate 2 by performing anisotropic etching from the surface of the flow-path substrate 2. The openings of the groove portions are closed by the nozzle substrate 3 and thereby the ink flow paths are defined. The ink flow paths include a plurality of pressure chambers 5 that correspond to the nozzles 8, common ink chambers 6 (reservoirs) into which ink for the pressure chambers is introduced, and ink supply passages 7 through which the common ink chambers 6 communicate with the pressure chambers 5.

An ink inlet port 9 extends in the direction of the thickness of the substrate through the bottom surface of a groove portion that serves as a common ink chamber 6 of the flow-path substrate 2. Thin portions 5*a* are formed in the bottom surfaces of the groove portions that serve as the pressure chambers 5. The thin portions 5*a* serve as resilient surfaces that are resiliently displaceable in the direction of the stacking of the head (the vertical direction in FIG. 2). A common electrode terminal 10 is formed on the flow-path substrate 2. Since the flow-path substrate 2 is electrically conductive, the thin portions 5*a* serve also as a common electrode. An insulating layer (not shown) made of inorganic glass is provided on the surface of the flow-path substrate 2 to which the electrode substrate 4 is bonded.

The electrode substrate 4 is made of borosilicate glass. The borosilicate glass has a coefficient of thermal expansion close to that of silicon. Therefore, separation between the members of the head due to temperature changes is unlikely to occur. Concave portions 4*a* in the form of shallow trays corresponding to the pressure chambers 5 are etched in the surface of the electrode substrate 4 that is bonded to the flow-path substrate 2, at locations opposite the thin portions 5*a* of the pressure chambers 5. An individual electrode 11 is formed on the bottom surface of each concave portion 4*a* by depositing a thin film of indium tin oxide (ITO) or the like. Each of the individual electrodes 11 includes a segment electrode 11*a* that extends along the corresponding pressure chamber 5, and an electrode terminal portion 11*b* that is exposed to the exterior. When the electrode substrate 4 is bonded to the flow-path substrate 2, each of the thin portions 5*a* of the pressure chambers 5 faces the segment electrode 11*a* of the corresponding individual electrode 11 with a narrow gap therebetween. The narrow gap is sealed by a sealing member 13.

An ink inlet passage 12 extends through the electrode substrate 4 in the direction of the thickness of the substrate. When the electrode substrate 4 is bonded to the flow-path substrate 2, the ink inlet passage 12 communicates with the ink inlet port 9. Ink is introduced into the common ink chamber 6 through the ink inlet passage 12 and the ink inlet port 9 from an ink tank (not shown) that is provided on the main-body side of the printer, for example. The ink in the common ink chamber 6 is distributed and supplied to the pressure chambers 5 through the ink supply passages 7 branching from the common ink chamber 6.

A drive signal is applied between the common electrode terminal 10 of the flow-path substrate 2 and an individual electrode 11 of the electrode substrate 4. When the voltage of the drive signal rises, the thin portion 5*a* is resiliently deformed and bent toward the individual electrode 11 by the electrostatic force generated between the thin portion 5*a* and the individual electrode 11 (the segment electrode 11*a*). As a result, the volume of the corresponding pressure chamber 5 increases, and ink flows from the common ink chamber 6 into the pressure chamber 5 through the ink supply passage 7. Then, when the voltage of the drive signal drops, the thin portion 5*a* is bent by its resilient force away from the individual electrode 11 toward the pressure-chamber side. As a result, the volume of the pressure chamber 5 decreases. Pressure change occurs in the ink in the pressure chamber 5 as a result of this sequence of operation. A first driving source is such that the pressure change is utilized and some ink in a first pressure chamber 5 is ejected as an ink droplet from a nozzle 8. That is, the thin portion 5*a*, the common electrode terminal 10, and the individual electrode 11 serve as a pressure-generating unit.

Figure 3A:
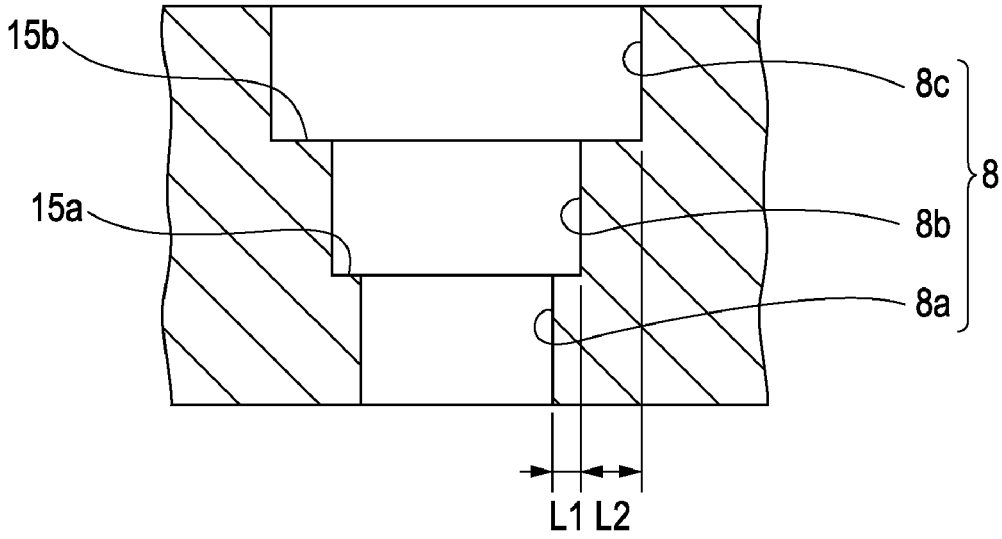
FIGS. 3A and 3B are diagrams illustrating a configuration of a nozzle.
Figure 3B:
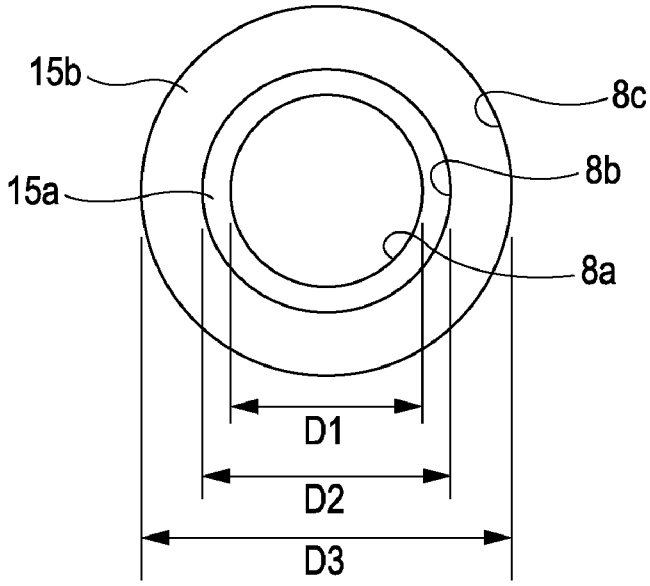

FIGS. 3A and 3B illustrate the configuration of a nozzle 8 in the present embodiment. FIG. 3A is a sectional view of the nozzle 8. FIG. 3B is a plan view of the nozzle 8 as seen from the pressure-chamber side. As shown in the FIGS. 3A and 3B, the nozzle 8 in the present embodiment includes a plurality of continuous nozzle sections coaxially arranged in the direction of the thickness of the nozzle substrate 3. More specifically, the nozzle 8 includes three cylindrical nozzle sections of a first nozzle section 8*a* located at the ejection-side end, a second nozzle section 8*b* located on the pressure-chamber side of the first nozzle section 8*a*, and a third nozzle section 8*c* located at the pressure-chamber-side end. The second nozzle section 8*b* is continuous with the first nozzle section 8*a*, and the third nozzle section 8*c* is continuous with the second nozzle section 8*b*.

The nozzle sections 8*a* to 8*c* have different diameters. The diameter D1 (the first diameter) of the first nozzle section 8*a* is the smallest. The diameter D2 (the second diameter) of the second nozzle section 8*b* is larger than D1. The diameter D3 of the third nozzle section 8*c* is the largest. That is, the nozzle sections have successively larger diameters from the first nozzle section 8*a*. Since the nozzle sections have different diameters, step portions 15 are formed at the boundaries between adjacent nozzle sections arranged in the direction of the thickness of the nozzle substrate 3. The step portions 15 are surfaces that join adjacent nozzle sections, and are parallel to the surface of the nozzle substrate. More specifically, a first step portion 15*a* is formed between the first nozzle section 8*a* and the second nozzle section 8*b*, and a second step portion 15*b* is formed between the second nozzle section 8*b* and the third nozzle section 8*c*. The nozzle sections 8*a* to 8*c* of the nozzle 8 are dimensioned such that the difference between the diameters D1 and D2 is not less than 0.1 and not greater than 0.4 relative to D1 ($0.1 \leqq (D2-D1)/D1 \leqq 0.4$). D1 is the diameter of the first nozzle section 8*a* located at the ejection-side end. D2 is the diameter of the second nozzle section 8*b* that is continuous with the first nozzle section 8*a*. This will be described below.

First, the process of forming the nozzle 8 will be described.

Figure 4A:
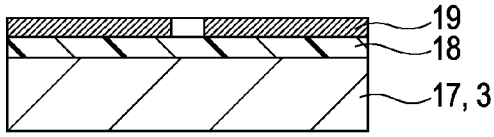
FIGS. 4A to 4I are diagrams illustrating a process of forming a nozzle.
Figure 4B:
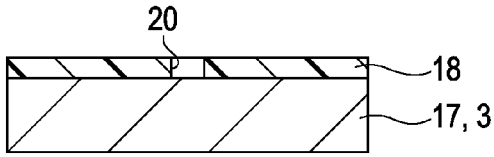
Figure 4C:
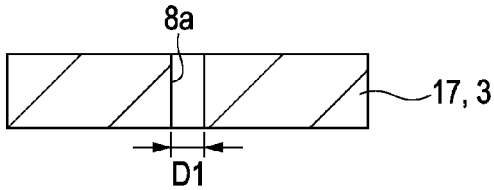

FIGS. 4A to 4I are sectional views illustrating the process of forming the nozzle. First, a layer of photoresist 18 is formed on the entire surface (the surface to be on the pressure-chamber side) of a silicon substrate 17 that serves as the nozzle substrate 3. A mask 19 for the pattern of the first nozzle section is formed on the photoresist 18 (FIG. 4A). The photoresist 18 is exposed and developed through the mask 19, and a resist pattern having an opening 20 at the portion corresponding to the first nozzle section 8*a* is formed (FIG. 4B). Anisotropic dry etching is performed on the silicon substrate 17 by using the resist pattern as the etching mask, and the first nozzle section 8*a* having a diameter of D1 is formed. Thereafter, the resist pattern is removed (FIG. 4C). The diameter of the nozzle section is adjusted by the size of the opening provided in the mask.

Figure 4D:
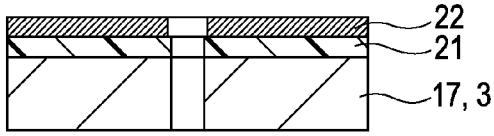
Figure 4E:
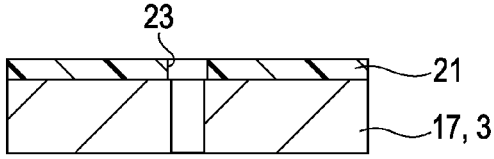
Figure 4F:
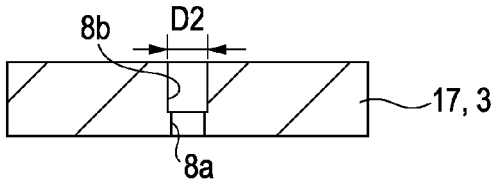

Next, the second nozzle section 8*b* is formed. A layer of photoresist 21 is again formed on the entire surface of the silicon substrate 17 in which the first nozzle section 8*a* has been formed. A mask 22 for the pattern of the second nozzle section is formed over the photoresist 21 (FIG. 4D). Exposure and development are performed through the mask 22, and a resist pattern having an opening 23 at the portion corresponding to the second nozzle section 8*b* is formed (FIG. 4E). Anisotropic dry etching is performed by using the resist pattern as the etching mask, and the second nozzle section 8*b* is formed (FIG. 4F). The inner diameter D2 of the second nozzle section 8*b* is adjusted such that the difference between the diameters D2 and D1 is not less than 0.1 and not greater than 0.4 relative to the diameter D1.

Figure 4G:
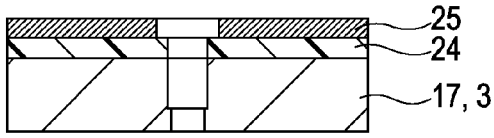
Figure 4H:
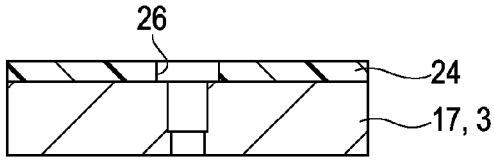
Figure 4I:
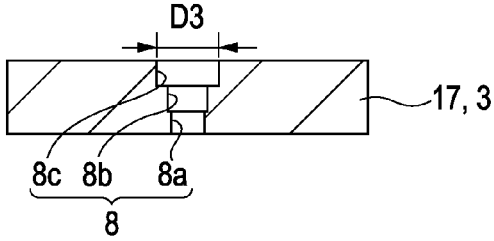

Next, the third nozzle section 8*c* is formed. A layer of photoresist 24 is formed on the surface of the silicon substrate 17 in which the first nozzle section 8*a* and the second nozzle section 8*b* have been formed. A mask 25 for the pattern of the third nozzle section is formed over the photoresist 24 (FIG. 4G). Exposure and development are performed through the mask 25, and a resist pattern having an opening 26 at the portion corresponding to the third nozzle section 8*c* is formed (FIG. 4H). Anisotropic dry etching is performed by using the resist pattern as the etching mask, and the third nozzle section 8*c* is formed (FIG. 4I). Flow-path resistance and inertance of the entire nozzle are considered, and the diameter D3 of the third nozzle section 8*c* is adjusted to the proper value. In the present embodiment, the difference in diameter between the second nozzle section 8*b* and the third nozzle section 8*c* (D3−D2) is larger than the difference in diameter between the first nozzle section 8*a* and the second nozzle section 8*b* (D2−D1). That is, the differences in diameter between adjacent nozzle sections are successively larger from the first nozzle section 8*a*. Therefore, the width L2 of the step portion 15*b* is larger than the width L1 of the step portion 15*a* (see FIG. 3A). The difference in diameter between the first nozzle section 8*a* and the second nozzle section 8*b* (D2−D1) may, of course, be equal to the difference in diameter between the second nozzle section 8*b* and the third nozzle section 8*c* (D3–D2), if the desired ink-ejecting characteristic is obtained by using such a configuration.

The nozzle 8 is formed in the silicon substrate 17 by the above-described process. Then, a necessary surface treatment such as the formation of a water-repellent film is performed on the ejection-side surface of the silicon substrate 17. The nozzle substrate 3 is thus fabricated.

FIGS. 5A to 5E are sectional views of a portion around the nozzle illustrating displacement of the meniscus when ink is ejected from the nozzle 8 having the above-described configuration.

Figure 5A:
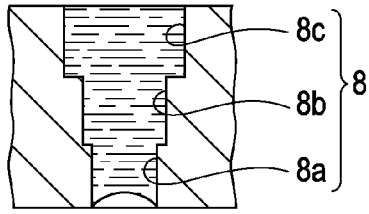
FIGS. 5A to 5E are sectional views illustrating displacement of the meniscus when ink is ejected from a nozzle.
Figure 5B:
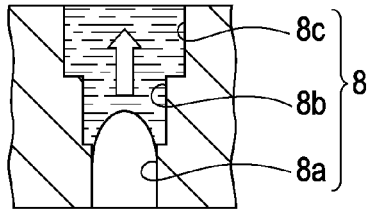
Figure 5C:
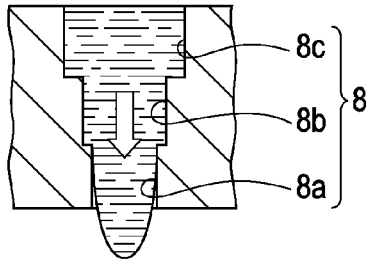
Figure 5D:
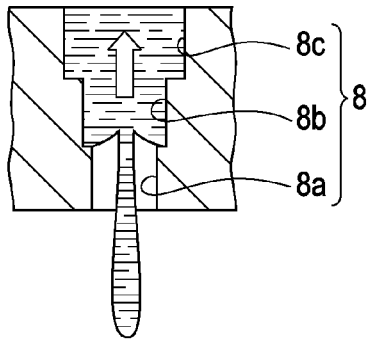
Figure 5E:
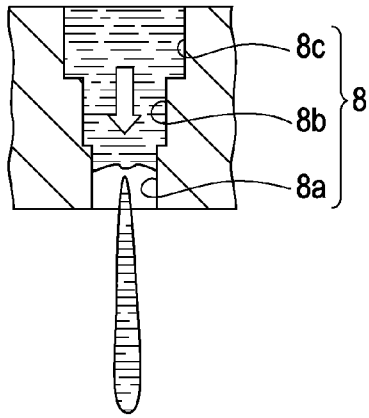

In the FIGS. 5A to 5E, the upper side is the pressure-chamber side, and the lower side is the ejection side (the object of ejection such as a recording sheet is located on the lower side). In a steady-state condition, the meniscus is located near the ejection-side opening of the nozzle 8. To eject ink from the nozzle 8, first, the pressure-generating unit is actuated and thereby the pressure chamber 5 is expanded and the pressure in the pressure chamber decreases. As a result, the meniscus is drawn toward the pressure-chamber side (FIGS. 5A and 5B). When the portion of the meniscus that contacts the inner wall of the nozzle has moved to near the boundary between the first nozzle section 8*a* and the second nozzle section 8*b*, the pressure chamber 5 which has been expanded is rapidly contracted and the pressure in the pressure chamber increases. As a result, the middle of the meniscus swells and is pushed toward the ejection side (FIG. 5C). Thereafter, to separate an ink droplet from the meniscus, the pressure chamber 5 is again expanded (FIG. 5D). Thereafter, the pressure chamber 5 is restored to its steady-state volume, and a predetermined amount of ink is ejected from the nozzle 8 (FIG. 5E).

As described above, in the present embodiment, the nozzle sections of the nozzle 8 are dimensioned such that the difference between the diameter D1 of the first nozzle section 8*a* and the diameter D2 of the second nozzle section 8*b* is not less than 0.1 and not greater than 0.4 relative to the diameter D1. Therefore, the first step portion 15*a* between the first nozzle section 8*a* and the second nozzle section 8*b* is made as small as possible. Consequently, an entraining flow of ink from the inner-circumferential-wall side of the nozzle toward the middle of the meniscus is less likely to occur near the first step portion 15*a*, as compared with a nozzle of the related art having a plurality of sections, which tends to have a large step portion. Therefore, the entrainment of bubbles in the meniscus is less likely to occur. Thus, unstable ink ejection due to bubbles can be prevented.

Figures 6, 7:
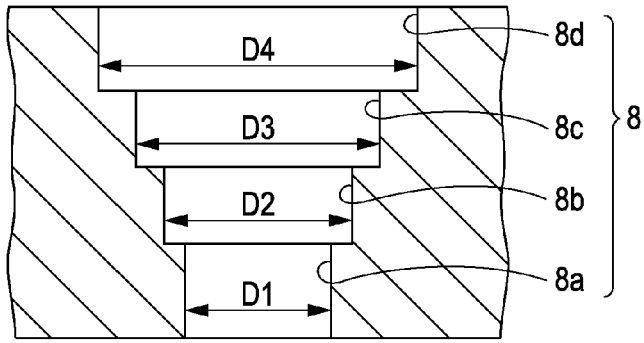
FIG. 6 is a table showing the result of an experiment to evaluate whether or not entrainment of bubbles in the meniscus can be prevented under various conditions of the nozzle.
FIG. 7 is a diagram illustrating the configuration of a nozzle of a second embodiment.
Figure 8A:
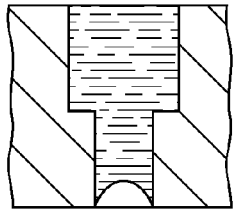
FIGS. 8A to 8E are sectional views illustrating displacement of the meniscus when ink is ejected from a nozzle of the related art.
Figure 8B:
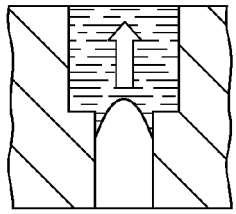
Figure 8C:
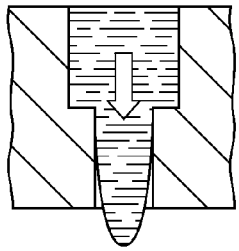
Figure 8D:
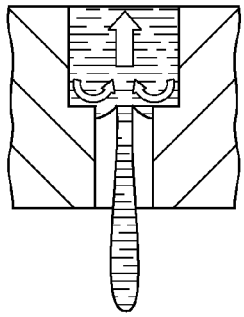
Figure 8E:
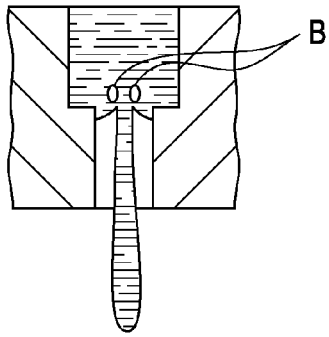

FIG. 6 is a table showing the result of a test to evaluate whether or not the entrainment of bubbles in the meniscus can be prevented. The test was performed with various ratios of the difference between the diameter D1 of the first nozzle section 8*a* and the diameter D2 of the second nozzle section 8*b* of the nozzle 8 to the diameter D1. The cases where the entrainment of bubbles did not occur are denoted by GOOD. The cases where the entrainment of bubbles occurred are denoted by AVERAGE or BAD. As shown in FIG. 6, in all of the cases where the condition $(0.1 \leqq (D2-D1)/D1 \leqq 0.4)$ is satisfied, the entrainment of bubbles did not occur.

In the cases where this condition is not satisfied $((D2-D1)/D1>0.4)$, the entrainment of bubbles occurred. In the case of $((D2-D1)/D1<0.1)$, the meniscus moves toward the second nozzle section 8*b* beyond the boundary between the first nozzle section 8*a* and the second nozzle section 8*b* when the pressure chamber 5 is expanded and the pressure in the pressure chamber is decreased, and there is a risk that ejection of ink will be inhibited.

The shape of the nozzle 8 is not limited to the above-described example. For example, while the nozzle 8 is constituted of three nozzle sections 8*a* to 8*c* including the first nozzle section 8*a* and the second nozzle section 8*b* in the above-described example, the nozzle 8 may be constituted of four or more nozzle sections as shown in FIG. 7, for example. More specifically, the nozzle 8 shown in FIG. 7 is constituted of four cylindrical nozzle sections of a first nozzle section 8*a*, a second nozzle section 8*b*, a third nozzle section 8*c*, and a fourth nozzle section 8*d*. The first nozzle section 8*a* is located at the ejection-side end. The second nozzle section 8*b* is continuous with the pressure-chamber side of the first nozzle section 8*a*. The third nozzle section 8*c* is continuous with the pressure-chamber side of the second nozzle section 8*b*. The fourth nozzle section 8*d* is continuous with the third nozzle section 8*c* and is located at the pressure-chamber-side end. Even with this configuration, the entrainment of bubbles can be inhibited if the nozzle sections of the nozzle 8 are dimensioned such that the difference between the diameter D1 of the first nozzle section 8*a* located at the ejection-side end and the diameter D2 of the second nozzle section 8*b* is not less than 0.1 and not greater than 0.4 relative to the diameter D1 $(0.1 \leqq (D2-D1)/D1 \leqq 0.4)$.

In the above-described example, the pressure-generating unit is an electrostatic-type actuator that displaces a portion of a pressure chamber by using electrostatic force. However, the pressure-generating unit is not limited to this example, and the embodiment of the invention can be applied in configurations that use other pressure-generating units such as a piezoelectric element, a heat-generating element, and the like.

While the ink jet recording head 1, which is one type of liquid ejecting head, has been given as an example and described above, the embodiment of the invention can be applied in other liquid ejecting heads. For example, the embodiment of the invention can be applied in a color-material-ejecting head that is used in the manufacture of color filters of a liquid crystal display or the like, an electrode-material-ejecting head that is used in the formation of electrodes of an organic EL (electroluminescent) display, an FED (field emission display) or the like, a biological-organic-matter ejecting head that is used in the manufacture of biochips (biochemical devices), and so on. In a displays-manufacturing apparatus, solutions of color materials for R (red), G (green) and B (blue) are discharged from a color-material-discharging head. In an electrodes-manufacturing apparatus, a liquid-form material of electrodes is discharged from an electrode-material-discharging head. In a chips-manufacturing apparatus, a solution of biological organic matter is discharged from a biological-organic-matter discharging head.

What is claimed is:

1. A liquid ejecting head including a nozzle substrate made of crystalline material, in which a nozzle through which liquid is ejected is provided by an etching process, the nozzle comprising:

a plurality of continuous nozzle sections having different diameters arranged coaxially in a direction of thickness of the crystalline material, the nozzle sections including a first nozzle section that is located at an ejection-side end and that has a first diameter, and a second nozzle section that is continuous with the first nozzle section and that has a second diameter larger than the first diameter, wherein a difference between the first diameter and the second diameter is not less than 0.1 and not greater than 0.4 relative to the first diameter.

2. The liquid ejecting head according to claim 1, wherein the nozzle sections have successively larger diameters from the first nozzle section.

3. The liquid ejecting head according to claim 2, wherein the differences in diameter between adjacent nozzle sections are successively larger from the first nozzle section.

4. A method of manufacturing a liquid ejecting head that has a nozzle substrate made of crystalline material in which a nozzle through which liquid is ejected is provided, comprising:

forming in the crystalline material by an etching process a plurality of continuous nozzle sections having different diameters so as to be arranged coaxially in a direction of thickness of the crystalline material, the nozzle sections including a first nozzle section that is located at an ejection-side end and that has a first diameter, and a second nozzle section that is continuous with the first nozzle section and that has a second diameter larger than the first diameter, wherein a difference between the first diameter and the second diameter is made not less than 0.1 and not greater than 0.4 relative to the first diameter.

* * * * *